US005360365A

United States Patent [19]

Evans

[11] Patent Number: 5,360,365

[45] Date of Patent: Nov. 1, 1994

[54] SPORTS STADIUM MODEL

[76] Inventor: David P. Evans, 1100 Valley Ridge, Waco, Tex. 76712

[21] Appl. No.: 159,515

[22] Filed: Dec. 1, 1993

[51] Int. Cl.[5] ..... A63H 33/04; A63H 3/52

[52] U.S. Cl. ..... 446/110; 446/476; 446/85

[58] Field of Search ..... 446/85, 110, 117, 118, 446/122, 125, 87, 476, 477; 434/72, 73; 273/156, 276, 277; 52/6; D21/109, 114; D25/12

[56] References Cited

U.S. PATENT DOCUMENTS

| | | | |
|---|---|---|---|
| 1,258,788 | 3/1918 | Koch | 446/110 |
| 1,308,254 | 1/1919 | Otto | 446/122 |
| 1,873,748 | 8/1932 | Favreau . | |
| 1,935,542 | 11/1933 | Bursell | 446/110 |
| 2,315,463 | 3/1943 | Tingley et al. . | |
| 2,351,931 | 6/1944 | Debs . | |
| 2,493,435 | 1/1950 | Archambault | 446/122 |
| 2,635,359 | 4/1953 | Broschious . | |
| 3,589,057 | 6/1971 | Fechner | 446/476 |
| 4,650,437 | 3/1987 | Sitkus . | |
| 5,002,513 | 3/1991 | Weiss . | |
| 5,011,446 | 4/1991 | Feinberg | 446/476 |

FOREIGN PATENT DOCUMENTS

| | | | |
|---|---|---|---|
| 978621 | 4/1951 | France | 446/85 |
| 2642551 | 8/1990 | France | 446/476 |

OTHER PUBLICATIONS

Archtectural Forum, May 1960, p. 61, "Projects".

Robert Shaw Controls Co., Advertisement, Fortum p. 158, Sep. 1966.

*Primary Examiner*—Robert A. Hafer

*Assistant Examiner*—Jeffrey D. Carlson

*Attorney, Agent, or Firm*—Richard C. Litman

[57] ABSTRACT

An architectural model simulating a large sports stadium. Major architectural and structural elements are reflected as single or plural part scaled components, such as base, playing field, seats, general structure defining the overall shape, and, where appropriate, domed roof. Certain accessories are removable to enable reconfiguration for different sports events, these accessories including scaled signs, lights, goal apparatus, scoreboard, and the like. Similarly, exterior or other architectural components are provided in different forms reflecting various appearances and stages of construction at different historical eras.

7 Claims, 4 Drawing Sheets

SPORTS STADIUM MODEL

BACKGROUND OF THE INVENTION

1. FIELD OF THE INVENTION

The present invention relates to an architectural model, and more particularly to a model of a sports stadium.

2. DESCRIPTION OF THE PRIOR ART

Models of buildings have been proposed in the prior art for illustrating building construction detail, floor plans, and general external appearance. The following patents exemplify such efforts.

U.S. Pat. No. 2,315,463, issued to Clark N. Tingley et al. on Mar. 30, 1943 discloses an architectural model having shiftable modules.

U.S. Pat. No. 1,873,748, issued to Walter Favreau on Aug. 23, 1932, discloses a model of a commercial building built on a pedestal and providing drawers which are pulled out to reveal floor plans at corresponding elevations.

U.S. Pat. No. 2,351,931, issued to Victor Debs on Jun. 20, 1944, discloses apparatus and method for constructing reduced scale replicas of buildings, among other objects. Paper is cut, scored, and folded to form a representation of the exterior of the duplicated object.

U.S. Pat. No. 2,635,359, issued to Henry H. Broscious on Apr. 21, 1953, discloses a building model made from abutting blocks having paper exterior surfaces inscribed with representations of appropriate architectural features.

U.S. Pat. No. 4,650,437, issued to Paul V. Sitkus on Mar. 17, 1987, discloses modular model units representing plazas existing between adjacent high rise buildings.

U.S. Pat. No. 5,002,513, issued to Richard I. Weiss on Mar. 26, 1991, illustrates a reconfigurable model of industrial buildings. The model includes panels representing walls, windows, and similar surface features, and interfitting beams and columns to enable erection of the model.

None of the above inventions and patents, taken either singly or in combination, is seen to describe the instant invention as claimed.

SUMMARY OF THE INVENTION

The present invention provides a model of a sports stadium, and illustrates those features particular to a typical sports stadium. The invention also seeks to reproduce actual sports stadia in their various configurations. The actual configuration of an actual stadium may have changed over time, as architectural and structural changes have been made. Also, the stadium is seasonally modified to accommodate different types of events.

It is a principal purpose of the present invention to bring stadium models to the average model hobbyist, in much the same manner as model boats, automobiles, aircraft, and the like. The model should comprise several major constituent parts corresponding to the structure of the subject stadium. Preferably, the principal parts should include those portions of a stadium which are, in actual life, reconfigured to accommodate different activities, as well as those portions reflecting major structural and architectural features.

An example of a seasonal reconfiguration is the transition from baseball to football. Seating must be rearranged, and structural features peculiar to each sport or activity must be removed, and appropriate new features installed. The baseball field layout features, such as bases, pitcher's mound, and protective fences are removed, and goal posts are installed for the football season.

Accordingly, it is a principal object of the invention to provide a reduced scale model generally conforming to the principal architectural and structural features of a sports stadium.

An additional object of the invention is to provide a model reproducing the appearance of a sports stadium.

It is another object of the invention to provide a model of a sports stadium which is convertible to reflect changes that may have occurred over time to the principal architectural and structural features.

It is a further object of the invention to provide a model of a sports stadium selectively displaying features which change due to the varied activities carried out in a sports stadium.

Still another object of the invention is to provide a model of a sports stadium having ready, manually separable attachment of the various components, whereby the model is assembled for display, reconfigured to display different activities or stages of construction, and disassembled for storage.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
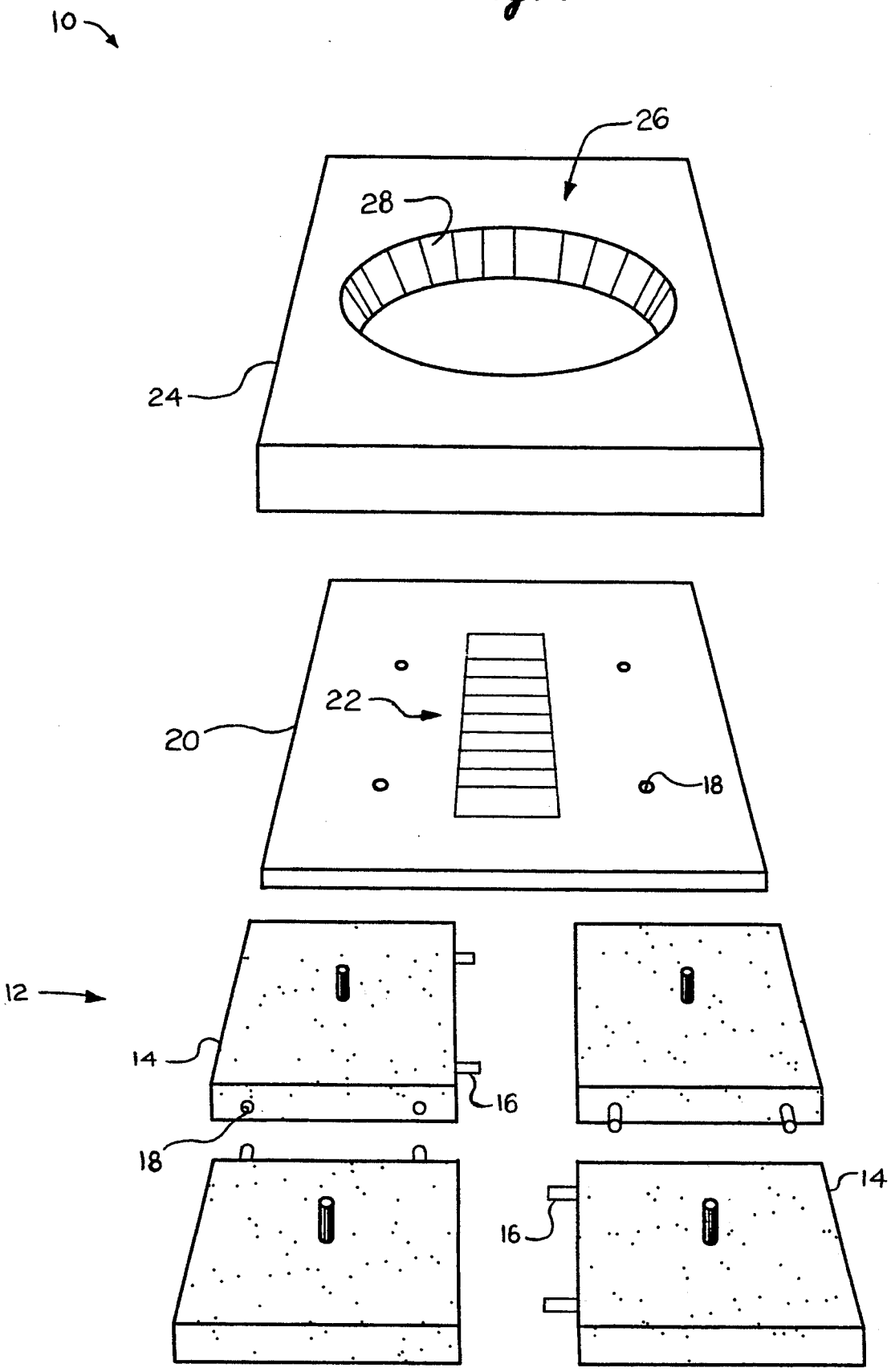
FIG. 1 is an exploded, perspective view of certain basic components of the novel stadium model.

With reference to FIG. 1 of the drawings, the novel sports stadium model 10 has a flat base 12 which enables the finished model to be placed on a tabletop or like supporting surface. It is anticipated that model 10 will be sufficiently large that base 12 is best formed in plural segments 14, having cooperating pegs 16 and holes 18 for detachable attachment thereof. Base 12 forms a sturdy foundation for remaining components, and need not bear features simulating an actual stadium.

Placed directly above base 12 is a playing surface member 20 which bears indicia 22 representative of a sports playing field. Playing surface member 20 may be of substantial thickness, or may be quite thin, such as a sheet of synthetic polymer, or may even be a decal placed on base 12. It is preferable that playing surface member 20 be removable, to enable another playing surface member to be substituted therefor, when it is desired to reconfigure model 10. The playing field actually depicted is that of a football field.

In a preferred embodiment, a body member 24 is provided, and is placed over base 12 and playing surface member 20. Body member 24 has a central depression 26 formed therein, and is open at the bottom to reveal the playing surface. Depression 26 has canted walls 28, which are arranged to parallel the arrangement of seating within an actual stadium.

Figure 2:
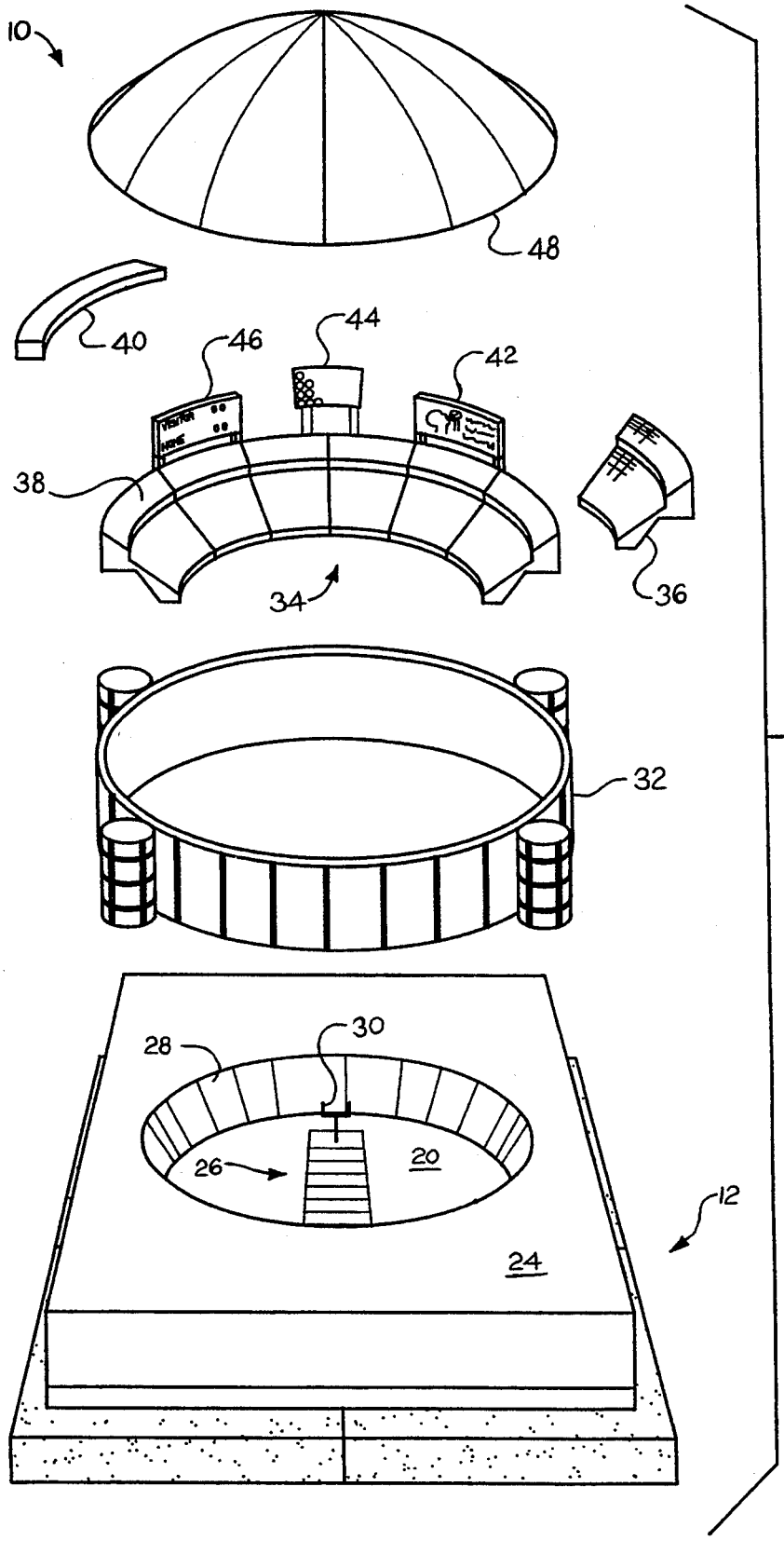
FIG. 2 is a partly exploded, perspective view of the components of FIG. 1 assembled, together with additional components.

Turning now to FIG. 2, the aforementioned components are shown assembled, and additional components are added. Playing field apparatus 30 may be attached to playing surface member 20. In this embodiment, apparatus 30 comprises a football goal post.

An exterior member 32 is placed on body member 24. Exterior member 32 is configured to simulate the subject stadium on its exterior surface. Seats 34 are placed inside exterior member 32, and are attached thereto or to body member 24, or to both. Seats 34 may be formed in seating sections 36, corresponding to division of seating within a typical actual stadium, or may be formed in larger sections, encompassing plural sections 36. Seats 34 may further be configured to simulate additional seating tiers 38. Enclosed seating sections may be provided as separate components 40, if not formed integrally with seating 34.

Additional accessory members, including a sign 42, light 44, and scoreboard 46 are preferably attached, as to seats 34. These accessory members will be provided selectively, dependent upon the actual stadium being simulated by model 10.

In the embodiment illustrated herein, a roof 48 is provided, simulating an enclosed stadium.

Figure 3:
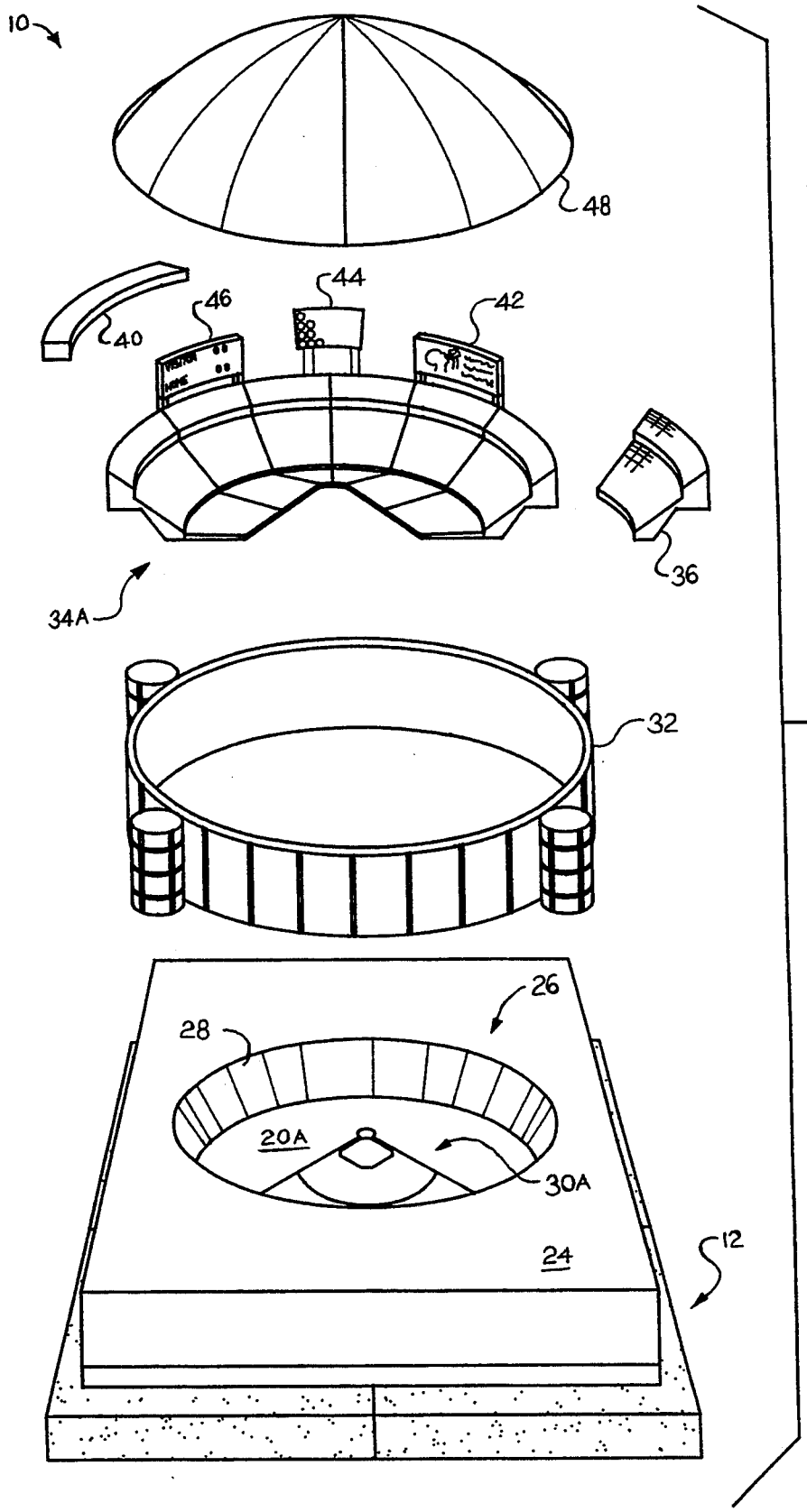
FIG. 3 is a partly exploded, perspective view of the components of FIG. 1 assembled, together with different additional components.

The components discussed thus far, except for base 12 and body member 24, are generally related to a first sport. An entire second set of components related to a second sports activity is, in the preferred embodiment, also provided. As shown in FIG. 3, model 10 is assembled in similar manner to the configuration illustrated in FIG. 2, but employing components related to the second sports activity. For example, an alternative playing surface member 20A is provided, together with appropriate alternative playing field apparatus 30A. In the embodiment depicted therein, a baseball field is provided, playing field apparatus 30A comprising bases and the like. Alternative seats 34A are now configured to cooperate with the changed playing field, as would be the case following seasonal conversion of a stadium from one sports activity to another.

Figure 4:
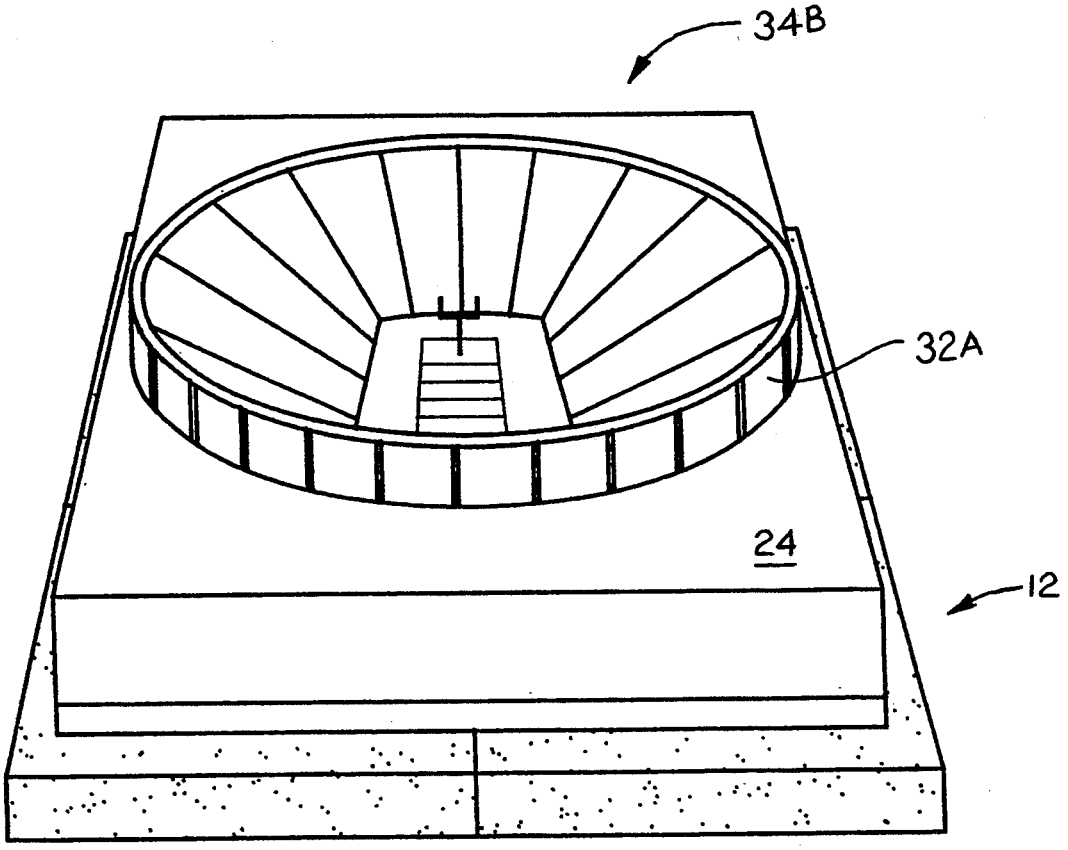
FIG. 4 is a perspective view of another sports stadium.

Another type of change which is encompassed by the present invention is modifications to structural or architectural features of a stadium. As seen in FIG. 4, alternative exterior member 32A and alternative seats 34B are shown. An alternative exterior member or other architectural member could simulate different configurations of the same stadium, as might have been reflected by evolution thereof over various historical eras. Another purpose which could be served by providing alternative components is to depict a different stadium.

The present invention may simulate stadia generally, or may be patterned after a particular stadium. To better simulate a stadium, the components described above are preferably scaled, or formed to a consistent scale, so that reconfiguration does not distort the scale, and hence the appearance, of the simulation.

Models made in pieces may be assembled permanently, as by permanently setting adhesives. While this technique may be employed in practicing the present invention, it is preferred that the pieces be detachably attachable, as by the peg and hole method illustrated in FIG. 1. Preferably, pegs 16 and holes 18 are located such that after assembly, they are concealed, as seen in FIGS. 1 and 2.

Obviously, models may be made in many ways, there being any possible number of components assemblable into a finished stadium. Any level of detail may be incorporated thereinto. Actual components may be included or ignored in a model. It is to be understood that the present invention is not limited to the sole embodiment described above, but encompasses any and all embodiments within the scope of the following claims.

I claim:

1. An assemblable and disassemblable architectural model kit of a sports stadium, comprising a base member;

a scaled playing surface member comprising indicia representative of a first sports field, said playing surface member being assemblable above and to said base member;

a body member having lateral side walls defining a depressed central area therein, said depressed central area being open at the bottom to reveal said playing surface member therethrough, said body member being assemblable above and to said base member;

a lower structure member fitted within and cooperating with said body member, open at the bottom to reveal said playing surface member therethrough, said lower structure member being assemblable within and to said body member;

a first scaled exterior member;

first accessory members including first scaled seats, and first scaled playing field apparatus, said first accessory members being related to a first sport; and second accessory members including second scaled seats, and second scaled playing field apparatus, said second accessory members being related to a second sport, whereby said architectural model is selectively reconfigurable by assembly and disassembly to simulate conditions relating to a second sports activity by substituting said first accessory members with said second accessory members.

2. The architectural model according to claim 1, further including a scaled roof.

3. The architectural model according to claim 1, further including a second scaled exterior member providing an external appearance different from that of said first scaled exterior member, whereby said architectural model is configurable to reflect architectural conditions of another era.

4. An assemblable and disassemblable architectural model kit of a sports stadium, comprising a base member;

a scaled playing surface member comprising indicia representative of a first sports field, said playing surface member being assemblable above and to said base member;

a body member having lateral side walls defining a depressed central area therein, said depressed central area being open at the bottom to reveal said playing surface member therethrough, said body member being assemblable above and to said base member;

a lower structure member fitted within and cooperating with said body member, open at the bottom to reveal said playing surface member therethrough, said lower structure member being assemblable within and to said body member;

a first scaled exterior member;

a second sealed exterior member providing an external appearance different from that of said first scaled exterior member, whereby said architectural model is configurable to reflect architectural conditions of another era;

first accessory members including first scaled seats, and first scaled playing field apparatus, all said first accessory members being related to a first sport;

second accessory members including second scaled seats, and second scaled playing field apparatus, all of said second accessory members being related to a second sport, whereby said architectural model is reconfigurable by assembly and disassembly to simulate conditions relating to a second sports activity substituting said first accessory members with said second accessory members; and a scaled roof.

5. An architectural model kit according to claim 4 wherein said first accessory members further includes first scaled signs and first scaled lights.

6. An architectural model kit according to claim 5 wherein said second accessory members further includes second scaled signs and second scaled lights.

7. An architectural model kit according to claim 4 wherein said second accessory members further includes second scaled signs and second scaled lights.

* * * * *